United States Patent [19]

Conrad

[11] 4,374,515

[45] Feb. 22, 1983

[54] FIREPLACE AIR DISTRIBUTION SYSTEM

[76] Inventor: Robert Conrad, P.O. Box 1004, Cedar Ridge, Calif. 95924

[21] Appl. No.: 133,460

[22] Filed: Mar. 24, 1980

[51] Int. Cl.[3] ..... F24B 13/02

[52] U.S. Cl. ..... 126/143; 126/242

[58] Field of Search ..... 126/143, 120, 279, 288, 126/242, 286, 285 R, 121, 289, 77; 236/45; 98/103, 121 A

[56] References Cited

U.S. PATENT DOCUMENTS

| | | | |
|---|---|---|---|
| 2,103,171 | 12/1937 | Nilson | 126/120 |
| 2,375,318 | 5/1945 | Mudgett | 126/143 X |
| 2,409,731 | 10/1946 | Bolinger | 126/120 |
| 2,819,711 | 1/1958 | Robinson | 126/242 X |
| 2,863,443 | 12/1958 | Hoffman | 126/143 X |
| 3,168,088 | 2/1965 | Martin et al. | 126/77 |
| 4,106,475 | 8/1978 | Mayes | 126/242 X |
| 4,163,440 | 8/1979 | Stultz | 126/77 X |
| 4,180,051 | 12/1979 | Maier et al. | 126/77 |
| 4,243,015 | 1/1981 | Trytten | 126/120 |

*Primary Examiner*—James C. Yeung
*Assistant Examiner*—Randall L. Green
*Attorney, Agent, or Firm*—Wagner & Bachand

[57] ABSTRACT

A combustion air system for fireplaces capable of introducing outside air to the firebox of a fireplace in a position for efficient distribution within the firebox. The system includes both manual and thermostatic operation for controlling the quantity of combustion air reaching the firebox. The system employs the existing ash trap as the source of combustion air thereby allowing the installation of this improved combustion air system without structural modification of the firebox and without interference with the normal use of the ash trap. The system includes a domed chamber which is substituted for the ash trap door and a draft controlling damper for controlling the quantity of combustion air. The damper is controlled by a manual push rod extending from the exterior of the fireplace to the firebox and engages the same damper. The control rod is enclosed within a tubular housing which further encloses a heat responsive spring acting as a thermostat to open the damper as the temperature decreases and close the damper as the heat increases in order to provide a stoking effect upon the fire in the firebox.

4 Claims, 8 Drawing Figures

FIG. 1
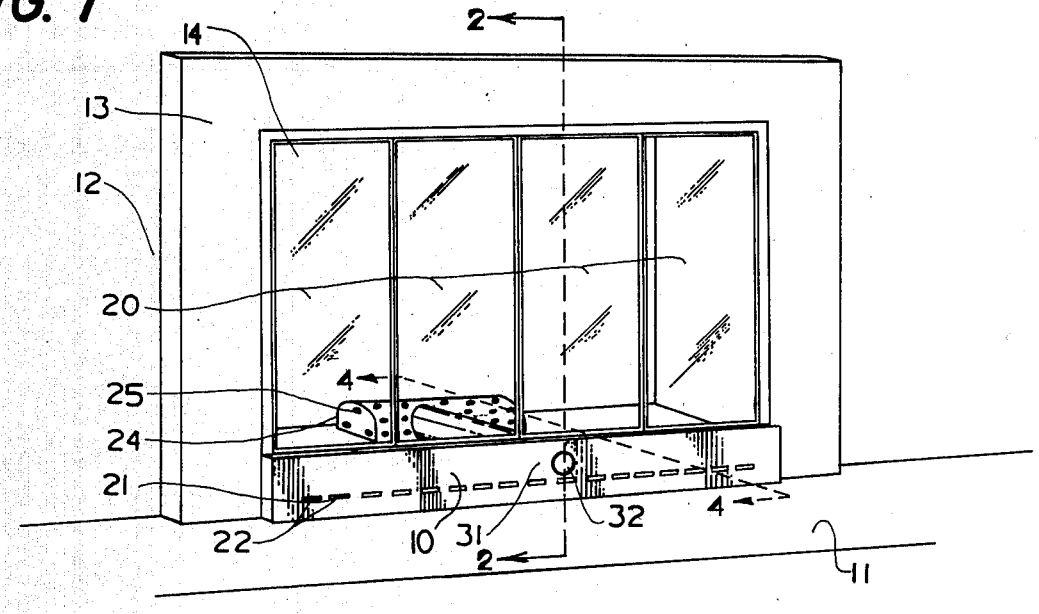
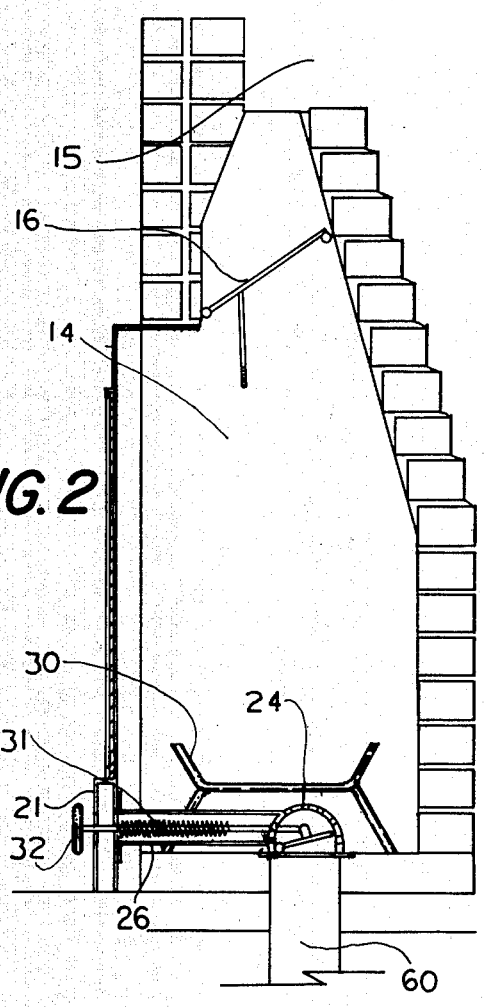
FIG. 2
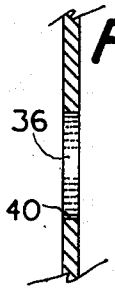
FIG. 6
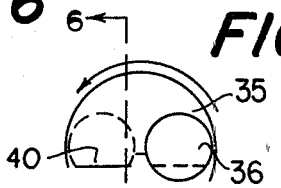
FIG. 7
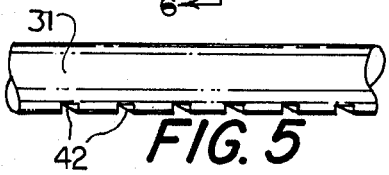
FIG. 5
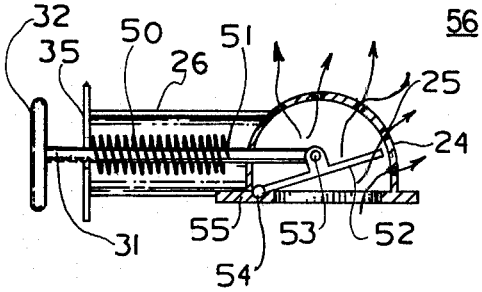
FIG. 4

FIREPLACE AIR DISTRIBUTION SYSTEM

BACKGROUND OF THE INVENTION

It has been authoritatively estimated that the conventional american fireplace extracts as much warm air from the room which it is intended to heat as it introduces into the room. This phenomenon occurs since the principal source of air for combustion is the room air itself. All of which tends to be at the room temperature. The constant drawing of room air causes that air to be replenished by outside air seeping in through cracks or drawn from other rooms, and is in actuality counterproductive. Drawing of the draft from the room does aid in minimizing smoke entrance into the room but this can be achieved successfully by the use of proper chimney design, flue damper, and care in operation.

In recent years of increasing costs of fuel oil there has been a renewal of interest in the room fireplace as a source of heat. This increase in interest has been further augmented by recent advances in the design of fireplace grates which draw air from the room, heat it, and return it, either using convection currents, or in certain cases using air pumps. Again, such system fails to take into account that combustion air is drawn from the room and in quantities far in excess of that which is heated in the grate and returned.

It has been recognized by others in the past that it is desirable to draw combustion air from the exterior and a number of special fireplace designs have been produced with that thought in mind. Each of them have added complications.

None of the foregoing solve the problem for the existing fireplace without any provision for drawing outside air. Many of these existing fireplaces however do include an ash trap which characteristically includes one or more hinged doors which may be depressed to allow ashes to be swept or dragged to a chamber below or to the rear of the fireplace. The ash trap door is used seldom, if ever, and has no operating function when the fireplace is in operation.

BRIEF STATEMENT OF THE INVENTION

Faced with the foregoing, it has been my discovery that the ash door can be the basis for providing combustion air to a fireplace without drawing combustion air from the room.

Based upon this discovery I have developed a replacement assembly for the ash trap door which first allows it to be used for its conventional purpose and further provides a thermostatically or manually controlled damper and manifold or chamber for combustion air to aid in the control of the level of the fire and additionally to provide an even distribution of combustion air to the firebox without removing room air for combustion purposes.

My invention involves a domed chamber which is substituted for the ash trap door. Within the dome chamber is an intake damper which is pivoted to a closed position to block off entrance of air from the ash pit when the fireplace is not in use or for extreme minimum burning as when banking or stoking the furnace for the night. The intake damper is pivotable to an open position allowing the maximum desired air flow into the firebox. The dome is perforated with a plurality of holes to distribute the combustion air throughout a substantial volume of the firebox therefore promoting even burning.

A manual control is coupled to the intake damper and extends outside of the fireplace whereby one can manually control and set the extent of opening of the intake damper from the hearth region.

The manual control rod is encircled by a tubular chamber which extends through the firebox to the exterior of the fireplace. The tubular chamber encloses a thermostatically responsive spring member which is selectively coupled to the manual control for over-riding manual control and automatically controlling the setting of intake damper.

Thus in accordance with this invention:

A. combustion air for a fireplace is taken principally from the exterior of the room heated;

B. combustion air supplied through the existing ash trap;

C. combustion air is distributed by means of a perforated cover;

D. a manually controllable intake damper allows the control by the user of the amount of air available for combustion;

E. the intake damper is additionally controlled by a thermostatic member; and

F. all the above are interchanged without structural changes to the fireplace except the removal of the ash pit door.

BRIEF DESCRIPTION OF THE DRAWING

The foregoing invention may be more clearly understood from the following detailed description and by reference from the drawing in which:

FIG. 1 is a perspective view of a fireplace including this invention;

FIG. 2 is a side vertical sectional view through the fireplace of FIG. 1 taken along lines 2—2 of FIG. 1;

FIG. 4 is a vertical section through the assembly of FIG. 2 taken along lines 4—4 of FIG. 2;

FIG. 5 is an enlarged fragmentary section of the manual control rod of the assembly of FIG. 3;

FIG. 6 is an enlarged vertical elevational view of the end opening in the control rod housing;

FIG. 7 is a fragmentary vertical section of the end of the control rod housing of FIG. 6 taken along lines 7—7 of FIG. 2.

DETAILED DESCRIPTION OF THE INVENTION

Figure 3:
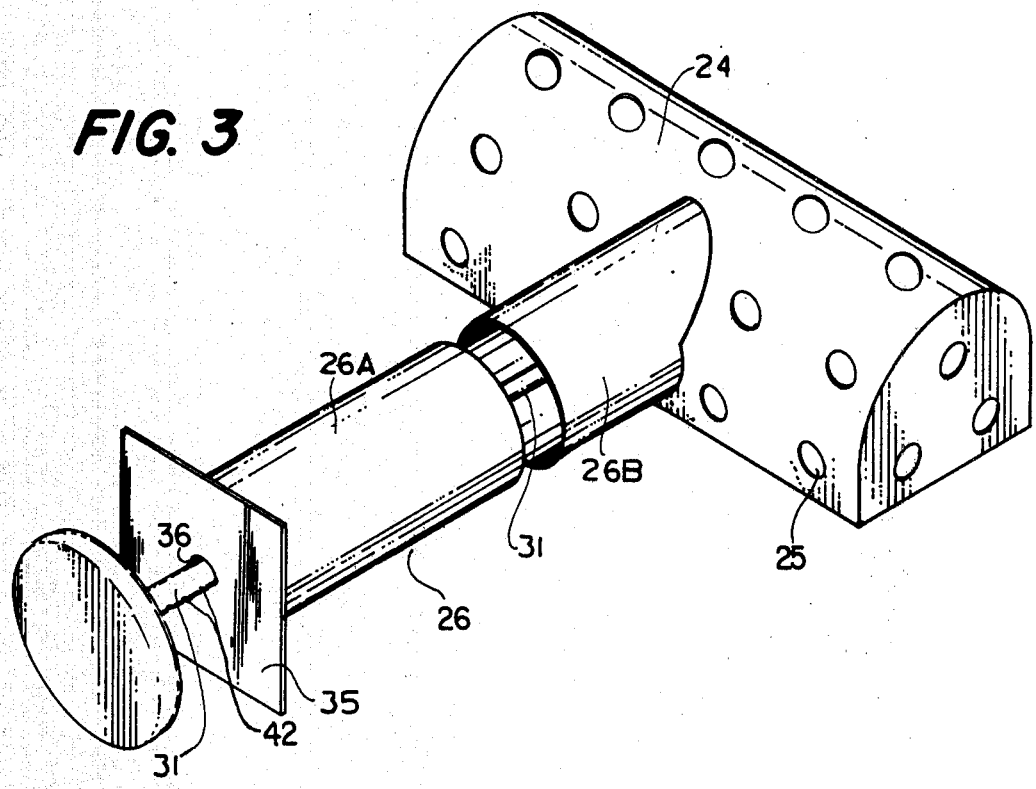
FIG. 3 is an enlarged perspective view of the working assembly of this invention.

Referring to FIG. 1, a typical american fireplace is disclosed including a hearth 11 in front of the fireplace which is built into the wall 12 surrounded by an ornamental frame 13. The fireplace includes a firebox or combustion chamber 14 communicating with a chimney unshown in FIG. 1 but appearing in FIG. 2 chimney via and a chimney damper 16 of FIG. 2 but unshown in FIG. 1. The front of the fireplace 10 in this case is enclosed with thermally radiant glass panels 20 constituting the firescreen. These glass panels 20 are mounted for bifold or sliding movement to allow the firebox 14 to be opened for stoking with fuel. The glass panels 20 are located above a base panel 21 usually of metal and including a number of draft openings 22 through which room air is drawn for the combustion within the firebox 14. Other types of room air supply are commonly used including in certain cases an air fan.

In FIG. 1 the log rack has been removed so that the damper control system of this invention may be more clearly seen. It comprises a domed housing 24 having a number of perforations 25 through which combustion air hereinafter described enters the combustion chamber or firebox 14. In FIG. 2 the log rack 30 is shown positioned over the assembly over the domed chamber 24.

Extending to the room side of the firebox from the domed chamber 24 is a control rod housing 26 through which control rod 31 shown in FIG. 2 extends to the exterior to be moved by inward and outward movement of knob 32.

The overall appearance of the assembly of this invention is best seen in FIG. 3 in which the dome shape of chamber 24 is readily apparent and the broad positioning of the combustion air openings 25 around the dome are clearly shown.

The tube 26 as illustrated in FIG. 3 may optionally be produced from a pair of telescoping tube sections 26A and 26B which provide a slight degree of adjustment in order to allow the positioning of dome 24 over the ash door of the firebox. The tube parts 26A and 26B must have sufficient resistance to slippage such as they will not move during the thermostatic operation of the apparatus. It is clearly apparent in FIG. 3 that the rod 31 is rigid and that the front of tube 26A terminates in a closed end 35 having a shaped opening 36 therethrough. The shaped opening 36 in fact is preferably configured, as shown in FIG. 7, as including one side corresponding in shape with the cross sectional shape of rod 31, e.g. round and a second portion including a lip 40 for engaging the teeth 42 of the rod 31, shown in FIG. 5. Rod 31 is located in the right hand portion of the opening as shown in FIG. 3 the rod 31 may move by merely sliding in and out. This position is used for automatic operation as hereinafter described. When the rod 31 is a shown in FIG. 3 positioned on the left, the teeth 42 shown on its underside engage the lip 40 and hold the rod 31 from inward or outward movement.

The notches in the rod 31 as shown in FIG. 5 to be rectangular so that when engaging the lip 40 the rod is restrained from both inward and outward movement.

Encircling the rod 31 as best seen in FIG. 4 is a helical spring 50 which bears at one end against the plate 35 and is secured to rod 31 at a point 51 either by extending through the rod 31 or by other fastening means. The spring 50 is selected from spring material having thermo properties allowing expansion and contraction over its length sufficient to allow inward and outward movement of the rod 31 to open and close inlet damper 52 which pivotably engages rod 31 at joint 53. The damper itself 52 is pivotably secured at point 54 to a bottom plate 55 of the assembly 56. This plate 55 rests over the ash pit opening 60 as is best seen in FIG. 2 in place of the former ash pit door or doors of the firebox 14. Thus, the movement of air into the firebox 14 is along the arrows of FIG. 4.

Figure 8:
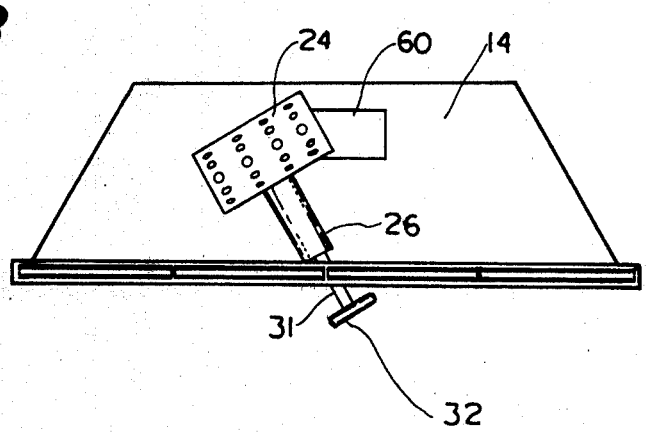
FIG. 8 is horizontal plan view of the bottom of the firebox of a fireplace employing this invention.

It should be noted that the only physical connection between the assembly of this invention and the fireplace is that the plate 55 rests over the ash pit opening 60 and the rod 31 extends through the front panel 21 of the firescreen. In the past, opening of the ash pit door is sometimes difficult, requiring a poker to reach and clear debris from the ash pit hinges and pivot the ash pit door to an open position, now the ash pit door region is virtually free of ashes. Merely a rotating movement in a horizontal plane of the rod 31 will slide the plate 55 and dome chamber 24 to one side in an arcuate movement allowing the ash pit door to be opened and one side of the firebox 14 cleared. The process may then be reversed and the plate 55 slid to the opposite side of the firebox 14 clearing the ashpit door for pushing the ashes down into the ash pit. Thereafter the assembly may be slid back to its original position and the assembly ready for a normal operation. The movement as described above is illustrated in FIG. 8.

MANUAL OPERATION

In manual operation, the knob 32 is grasped, the teeth or notches of the rod 31 disengaged from stop 40 by lifting the rod 31 up slightly. Next, the knob is pulled outward to provide more air to the combustion chamber or inward to provide less air, as for stoking for the night. The selected position is maintained by reengaging the rod teeth 42 with the stop 40.

AUTOMATIC THERMOSTATIC OPERATION

For automatic thermostatically controlled operation, the knob 32 is grasped, the rod 31 is moved to the unstopped side of the opening in plate 35 whereby the rod 31 may freely move in and out. As the temperature of the spring 50 increases, the spring 50 elongates. One end is secured against plate 35 and the other, or inner end of spring 50 causes the rod 31 to move inward tending to close the damper 52. As the firebox 14 cools off with a lower fire, the spring 50 cools and shortens, moving rod 31 outward and supplying more air to the firebox 14. The cycle can repeat continuously.

The above described embodiments of this invention are merely descriptive of its principles and are not to be considered limiting. The scope of this invention instead shall be determined from the scope of the following claims, including their equivalents.

What is claimed is:

1. A fireplace combustion air assembly comprising an intake damper adapted to fit the ash pit opening and replace an ash pit door of a fireplace:

means mounting said intake damper for pivotable movement between a closed and open position and partial open positions therebetween;

means defining a chamber positioned over said damper with sufficient clearance to allow pivotable movement of said damper;

said chamber including at least one opening therein to allow combustion air to enter the firebox of a fireplace therethrough;

manual control means coupled to said intake damper for manually changing the position of said intake damper to control the quantity of combustion air introduced into said firebox via the ash pit opening; and including thermostatic control means extending into said firebox and coupled to said intake damper for controlling the extent of opening of said intake damper as a function of the temperature within the firebox.

2. The combination in accordance with claim 1 wherein said thermostatic control means is coupled to said manual control means for controlling said intake damper via said manual control means.

3. The combination in accordance with claim 1 wherein said manual control means includes a rod, and wherein said thermostatic control means comprises a thermally responsive spring engaging said rod and said means defining said chamber whereby said spring adjusts the position of said rod responsive to temperature changes of said spring to open and close said intake damper.

4. The combination in accordance with claim 3 wherein said rod and spring are enclosed within an elongated housing extending between said chamber defining means and the front of the fireplace.

* * * * *